US005468926A

United States Patent [19]

Sato

[11] Patent Number: 5,468,926

[45] Date of Patent: Nov. 21, 1995

[54] SWITCH DEVICE

[75] Inventor: Hiroshi Sato, Saitama, Japan

[73] Assignee: Toyo Denso Kabushiki Kaisha, Tokyo, Japan

[21] Appl. No.: 233,783

[22] Filed: Apr. 26, 1994

[30] Foreign Application Priority Data

Apr. 27, 1993 [JP] Japan ..... 5-022239 U

[51] Int. Cl.[6] ..... H01H 21/82

[52] U.S. Cl. ..... 200/558; 200/553; 200/557

[58] Field of Search ..... 200/558, 553, 200/556, 557, 559, 561, 562, 61.27, 560, 563, 551, 547, 244, 245

[56] References Cited

U.S. PATENT DOCUMENTS

| | | | |
|---|---|---|---|
| 3,075,062 | 1/1963 | Iaccarino | 200/557 |
| 4,022,999 | 5/1977 | Brown | 204/67 G |
| 4,121,068 | 10/1978 | Peck | 200/67 G |
| 4,408,105 | 10/1983 | Tanaka | 200/68 |
| 4,584,546 | 4/1986 | Hattori et al. | 335/186 |
| 4,808,775 | 2/1989 | Satoh et al. | 200/10 |
| 5,293,507 | 3/1994 | Hayakawa | 200/275 |

FOREIGN PATENT DOCUMENTS

| | | |
|---|---|---|
| 56-162829 | 12/1981 | Japan . |
| 59-138141 | 9/1984 | Japan . |
| 60-35441 | 3/1985 | Japan . |
| 64-9333 | 1/1989 | Japan . |

*Primary Examiner*—Henry J. Recla
*Assistant Examiner*—David J. Walczak
*Attorney, Agent, or Firm*—Armstrong, Westerman, Hattori, McLeland & Naughton

[57] ABSTRACT

A switch device includes a conductive plate which is embedded in a housing of a synthetic resin and has one end projecting from the housing. A substantially V-shaped movable contact is supported at the one end of the conductive plate. An urging pin is carried on an operating member swingable about an axis parallel to an axis of swinging movement of the movable contact and is resiliently brought into abutment against the movable contact. In such switch device, support sections are integrally provided on one of inclined portions of the movable contact for receiving one end of the conductive plate which is formed into a non-bent flat plate-like configuration. Thus, it is unnecessary to conduct the bending of the conductive plate, and the movable contact can be swingably supported at the one end of the conductive plate, leading to an enhanced assembling efficiency.

11 Claims, 6 Drawing Sheets

SWITCH DEVICE

BACKGROUND OF THE INVENTION

1. Field of the Invention

The present invention relates to a switch device comprising a conductive plate embedded in a housing of synthetic resin and having one end projecting from said housing, a pair of stationary contacts fixed on the housing on opposite sides of the conductive plate, a movable contact continuously provided with a pair of inclined portions formed in a substantially V-shape and provided at outer ends of the inclined portions with contact portions capable of being individually brought into contact with said stationary contacts, said first inclined portion being pivotally supported on the one end of the conductive plate, an operating member swingable about an axis parallel to an axis of pivoting movement of said movable contact, and an urging pin carried on said operating member and biased toward the movable contact by a spring, said switch device being capable of being switched to selectively bring said contact portions into and out of contact with the stationary contacts depending upon shifting of the contact position of said urging pin with said stationary contact in response to the swinging movement of said operating member.

2. Description of the Prior Art

Such switch devices are conventionally known, for example, from Japanese Utility Model Application Laid-open No. 35441/85.

In the above prior art switch device, the structure for pivotally supporting the movable contacts is as shown in FIG. 6. More specifically, a movable contact 29' includes a pair of inclined portions 26' and 27' connected in a substantially V-shape and having, at their outer ends, contact portions 24' and 25' which are capable of being individually brought into contact with a pair of stationary contacts 22' and 23' fixed on a housing 13' on opposite sides of a conductive plate 21'. In this movable contact 29', notches 45, 45 are provided at opposite sides of one inclined portion 26'. One end of the conductive plate 21' is formed into a substantially U-shape to engage such notches 45, 45 and bent to intersect the one inclined portion 26' at substantially right angles. The conductive plate 21' is embedded in the housing 13' made of synthetic resin. After coupling the conductive plate 21' to the housing 13' by molding, the mold or die must be removed from the plate 21'. Therefore, the bending operation of the one end of the conductive plate 21' must be done after completion of the molding-coupling. This results in a troublesome bending operation and an inferior assembling efficiency.

SUMMARY OF THE INVENTION

Accordingly, it is an object of the present invention to provide a switch device wherein the need for bending the conductive plate is eliminated, and the movable contact can be pivotally supported at one end of the conductive plate, thereby enhancing the assembling efficiency.

To achieve the above object, according to the present invention, there is provided a switch device comprising a conductive plate embedded in a housing of synthetic resin and having one end projecting from the housing, a pair of stationary contacts fixed on the housing on opposite sides of the conductive plate, a movable contact continuously provided with a pair of first and second inclined portions formed in a substantially V-shape and provided at outer ends of the inclined portions with contact portions capable of being individually brought into contact with the stationary contacts, the first inclined portion being swingably supported on the one end of the conductive plate, an operating member swingable about an axis parallel to an axis of pivoting movement of the movable contact, and an urging pin carried on the operating member and biased toward the movable contact by a spring, the switch device being switchable in order to selectively bring the contact portions into and out of contact with the stationary contacts depending upon shifting of a contact position of the urging pin with the movable contact in response to the swinging movement of the operating member, wherein the first inclined portion of the movable contact is integrally provided at opposite sides thereof with support sections for receiving the one end of the conductive plate which is formed into a non-bent flat plate-like configuration.

With the above construction, it is unnecessary to bend the one end of the conductive plate after mold-coupling the conductive plate to the housing, thereby enhancing the assembling efficiency.

Each support section is formed into a trapezoidal shape from a protruding portion protruding sideways from the first inclined portion, a supporting plate portion continuously extending from edge of the protruding portion adjacent the first inclined portion and toward a location on one side of the first inclined portion, and a limiting plate portion continuously extending from another edge of the protruding portion adjacent the second inclined portion. When the support section is formed in this manner, it is possible to easily form the support sections. It is possible to limit an excessive pivoting movement as well as an undesirable lengthwise displacement of the movable contact by the limiting plate portion to prevent to the utmost a deformation of the movable contact due to a pressure of the urging pin.

In addition, the construction may be such that the limiting plate portion limits the pivoting movement of the movable contact toward the second inclined portion. This makes it possible to easily limit the pivoting movement of the movable contact by the limiting plate portion.

Further, the movable contact may be formed from a single metal plate. Thus, it is possible to easily form the movable contact.

Yet further, the stationary contact corresponding to the contact portion of the first inclined portion may be placed at a level higher than that of the stationary contact corresponding to the contact portion of the second inclined portion. Thus, it is possible to reduce the range of pivoting movement of the movable contact to provide a shortened stroke of the movable contact coming onto contact with the stationary contact. It is also possible to decrease the biasing force on the urging pin to provide an enhanced durability for the movable contact.

In addition, according to a second aspect and feature of the present invention, there is provided a switch device comprising a conductive plate embedded in a housing of synthetic resin and having one end projecting from the housing, a pair of stationary contacts fixed on the housing on opposite sides of the conductive plate, a movable contact continuously provided with a pair of inclined portions formed in a substantially V-shape and provided at outer ends of the inclined portions with contact portions capable of being individually brought into contact with the stationary contacts, the first inclined portion being pivotally supported on the one end of the conductive plate, an operating member swingable about an axis parallel to an axis of pivoting movement of the movable contact, and an urging pin carried on the operating member and biased toward the movable contact by a spring, the switch device being switchable in order to selectively bring the contact portions into and out of contact with the stationary contacts depending upon shifting of the contact position of the urging pin with the movable contact in response to the swinging movement of the operating member, wherein the first inclined portion of the movable contact is provided at opposite sides thereof with support means engaging the projecting one end of the conductive plate.

When each of the support means comprises an inverted, substantially V-shaped support piece provided on the first inclined portion for engaging with the tip end of the conductive plate, it is possible to easily provide the support means.

The support piece may be comprised of a protruding portion protruding sideways from the first inclined portion, and a supporting plate portion continuously extending from one edge of the protruding portion adjacent the first inclined portion. Thus, it is possible to easily form the support piece.

Further, the support piece and the movable contact may be formed from a single metal plate. This facilitates the pressing operation.

Yet further, a limiting means for limiting the pivoting movement of the movable contact may be provided on the substantially V-shaped support piece. This makes it possible to reduce the range of pivoting movement of the movable contact to provide a shortened stroke of the movable contact coming into contact with the stationary contact. It is also possible to decrease the biasing force on the urging pin to provide an enhanced durability for the movable contact.

The limiting means may be comprised of a limiting plate portion mounted on the edge of the support piece and placed in abutment against the conductive plate during pivoting movement of the movable contact. Thus, the limiting means can be easily provided.

Further, the support piece, the limiting plate portion and the movable contact may be formed from a single metal plate. This facilitates the operation for forming the movable contact.

The above and other objects, features and advantages of the invention will become apparent from the following description of a preferred embodiment, taken in conjunction with the accompanying drawings.

BRIEF DESCRIPTION OF THE DRAWINGS

FIGS. 1 to 5 illustrate a preferred embodiment of the present invention, wherein FIG. 1 is a plan view of a master switch for a power window in an automobile vehicle;

FIG. 2 is a sectional view taken along a line 2—2 in FIG. 1;

FIG. 3 is an enlarged sectional view taken along a line 3—3 in FIG. 2;

FIG. 4 is a perspective view illustrating an arrangement of first and second switch mechanisms; and FIG. 5 is an exploded perspective view of a movable contact and a conductive plate.

DESCRIPTION OF THE PREFERRED EMBODIMENT

The present invention will now be described by way of a preferred embodiment in connection with the accompanying drawings.

Figure 1:
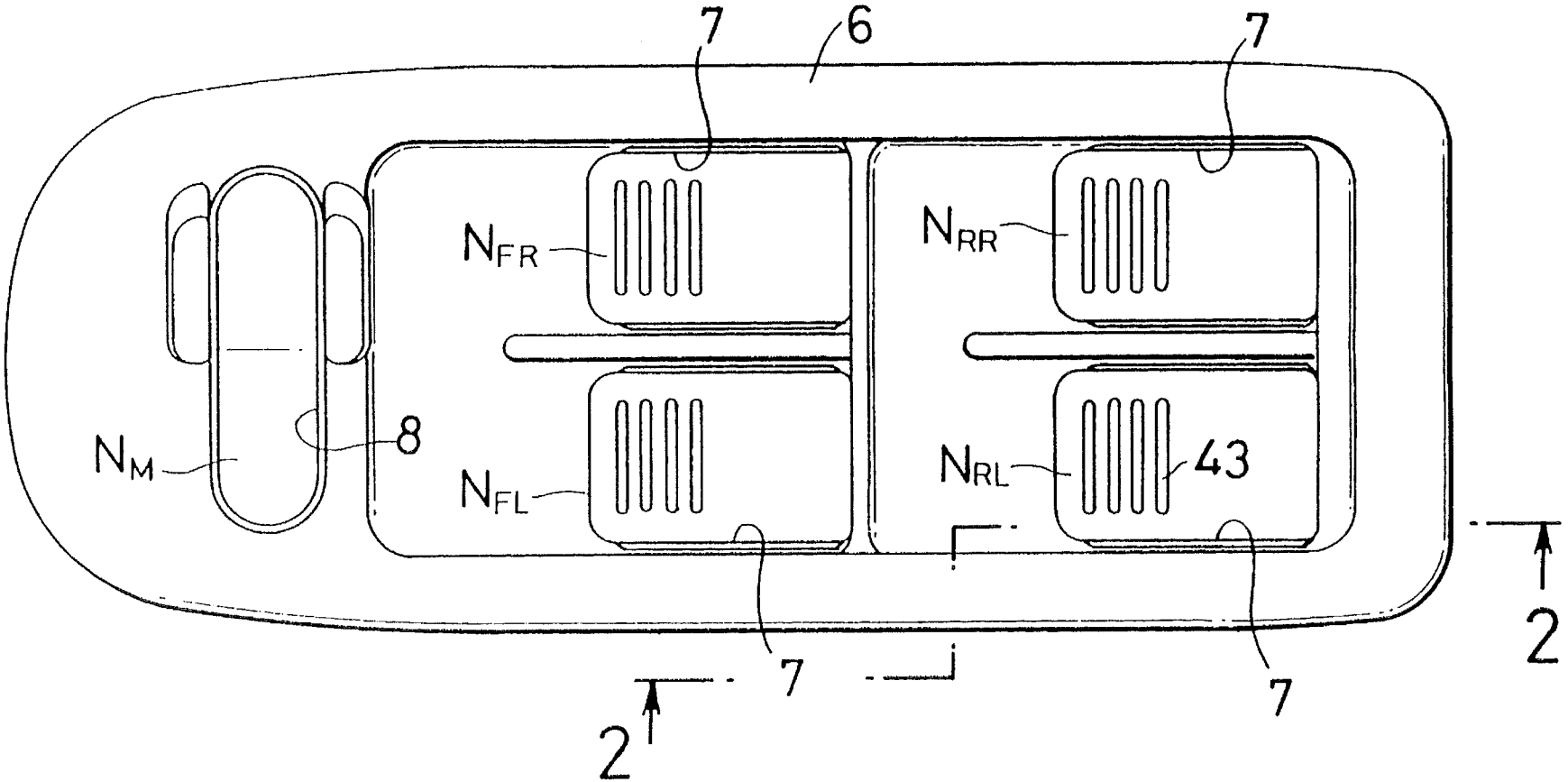

Referring first to FIG. 1, a switch device is a master switch for a power window, which is disposed on a driver-side door in an automobile vehicle, so that a window pane in the driver-side door (in a right hand drive automobile), e.g., a right front door can be lifted and lowered by the operation of a knob $N_{FR}$, and a window pane in a left front door can be lifted and lowered by the operation of a knob $N_{FL}$. In addition, a window pane in a right rear door can be lifted and lowered by the operation of a knob $N_{RR}$, and a window pane in a left rear door can be lifted and lowered by the operation of a knob $N_{RL}$. Further, a state permitting the window panes in the doors to be individually lifted and lowered and a state in which the individual lifting and lowering of the window panes in all the doors excluding the driver-side door are prohibited can be switched one from another by the operation of a knob $N_M$.

Figure 2:
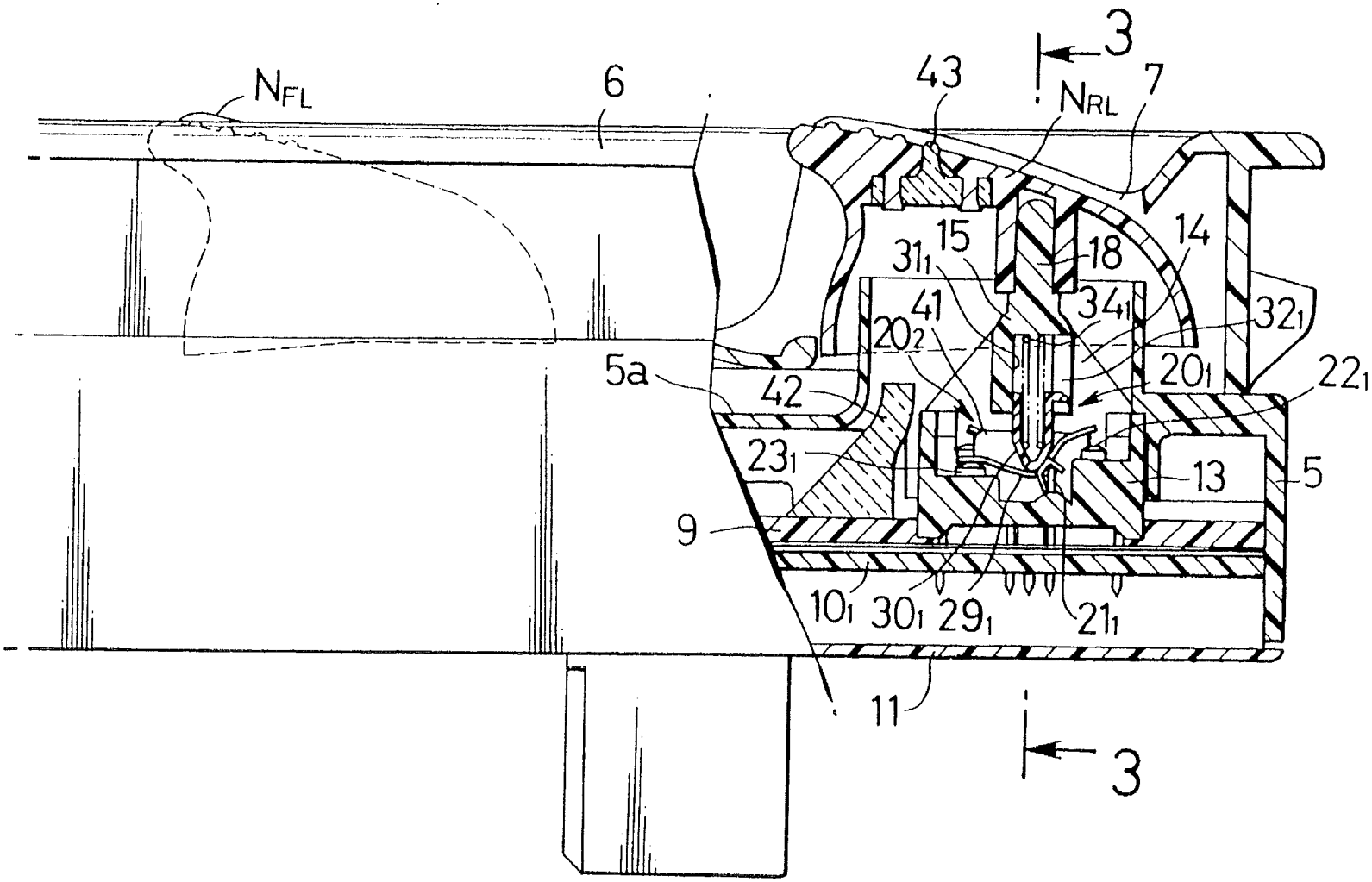
Figure 3:
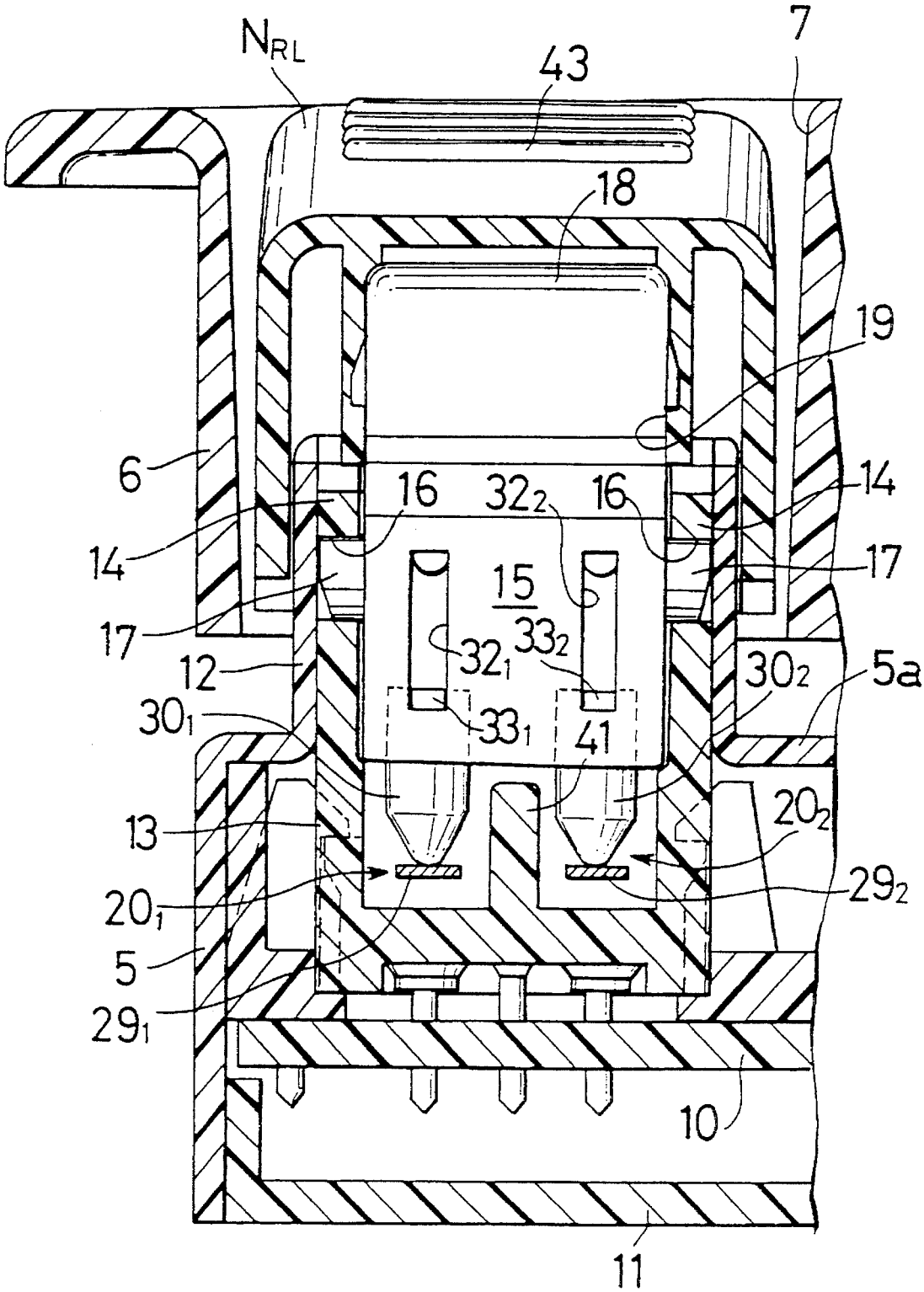

Referring also to FIGS. 2 and 3, a casing 5 is attached to the driver-side door and formed from synthetic resin into a rectangular box configuration having a longer dimension in the longitudinal direction of the vehicle. A garnish 6 formed of a synthetic resin into a rectangular box configuration is fixed to the casing 5 to cover an upper portion of the casing, and is provided with four operating openings 7 facing the knobs $N_{FR}$ to $N_{RL}$, respectively, and an operating opening 8 facing the knob $N_M$.

A support plate 9 is fixed to the casing 5, such that it is accommodated within the casing 5 below a ceiling plate portion 5*a* of the casing 5. A printed board 10 is fixed to a lower surface of the support plate 9, and an opening at a lower end of the casing 5 is closed by a back lid 11 below the printed board 10.

Sleeves 12, (FIG. 3) of a rectangular cross-section are integrally provided on the casing 5 to extend upwardly in correspondence to the operating openings 7. Housings 13 are engaged and fixed to the support plate 9 at locations corresponding to the sleeves 12. When the support plate 9 is fixed to the casing 5, each housing 13 is clamped between the ceiling plate portion 5*a* of the casing 5 and the support 9.

The housing 13 is formed from synthetic resin into a box configuration with its upper portion opened. The housing 13 is provided at its opposite sides with support walls 14, 14 which rise therefrom in a triangular shape and fitted into the sleeves 12 of the casing 5. Operating members 15 are carried on the support walls 14, 14 for tilting movement in a longitudinal direction of the vehicle. More specifically, support holes 16, 16 are provided in the support walls 14, 14 respectively to extend widthwise of the casing 5, and the operating member 15 is fitted between both the support walls 14, 14, such that projections 17, 17 integrally provided on opposite sides of the operating member 15 are fitted into the support holes 16, 16.

Upwardly extending fitting projections 18 are integrally provided on upper portions of the operating members 15, respectively. These fitting projections 18 are fitted and locked in fitting sleeves 19 which are provided on the knobs $N_{FR}$, $N_{FL}$, $N_{RR}$ and $N_{RL}$ disposed in the operating openings 7 in the garnish 6 so as to cover upper portions of the sleeves 12, respectively. Thus, the knobs $N_{FR}$, $N_{FL}$, $N_{RR}$ and $N_{RL}$ are connected to the operating members 15, respectively, so that the operating members 15 are swung about the projections 17, 17 in the longitudinal direction of the vehicle by operating the knobs $N_{FR}$, $N_{FL}$, $N_{RR}$ and $N_{RL}$ facing the operating openings 7, respectively.

A pair of first and second switch mechanisms $\mathbf{20}_1$ and $\mathbf{20}_2$ are provided for every knob $N_{FR}$, $N_{FL}$, $N_{RR}$, $N_{RL}$ and operated by the swinging operation of each of the operating members 15 in response to the operation of each of the knob. The switch mechanisms $\mathbf{20}_1$ and $\mathbf{20}_2$ basically have the same construction. Therefore, the structure of the first switch mechanism $\mathbf{20}_1$ operated in a switching manner by the knob $N_{RL}$ will be described in detail, while components of the second switch mechanism $\mathbf{20}_2$ operated in a switching manner by the knob $N_{RL}$, corresponding to those of the first switch mechanism $\mathbf{20}_1$, are shown by the similar reference characters with a subscript 2 added thereto.

Figure 4:
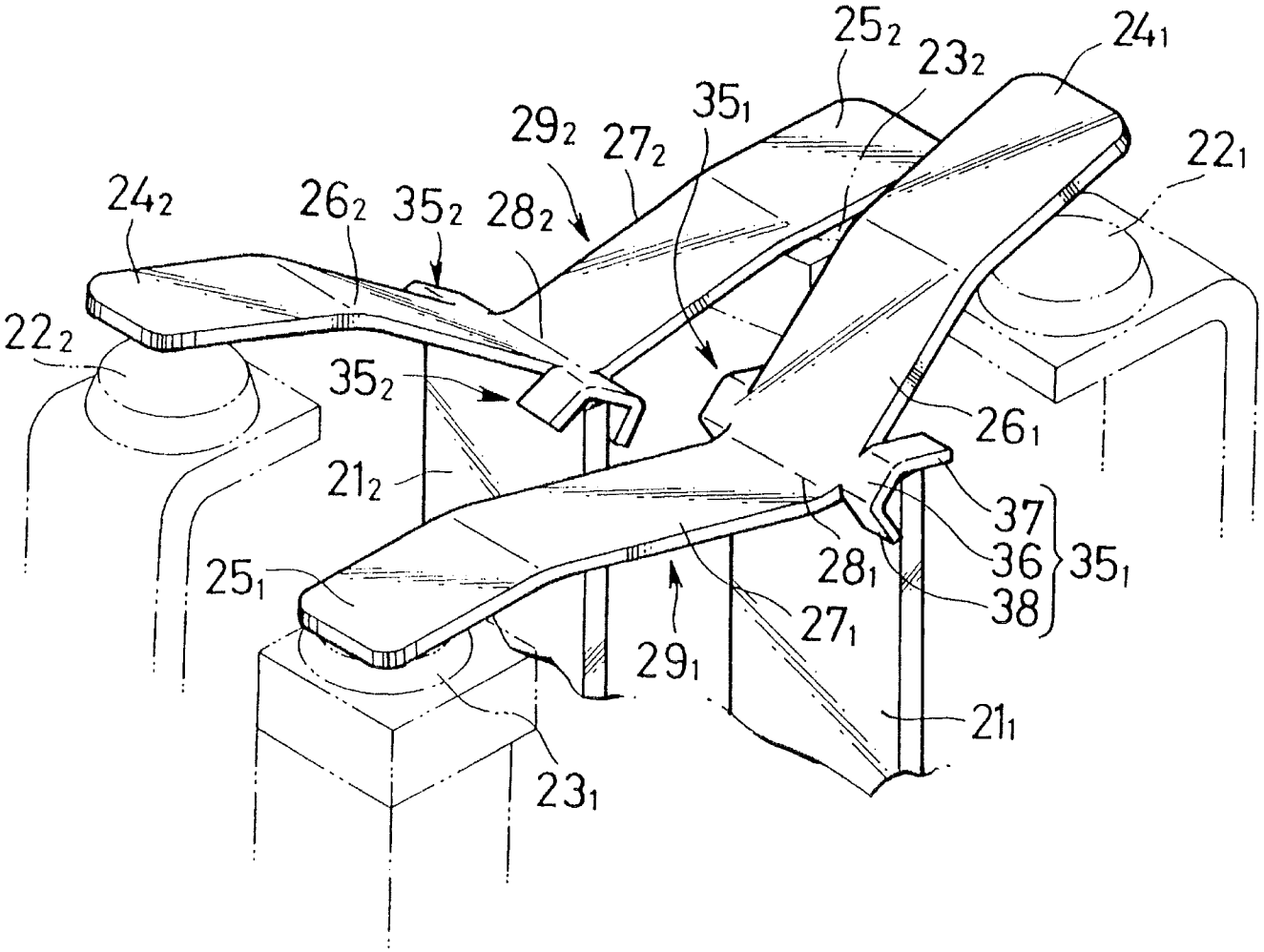
Figure 5:
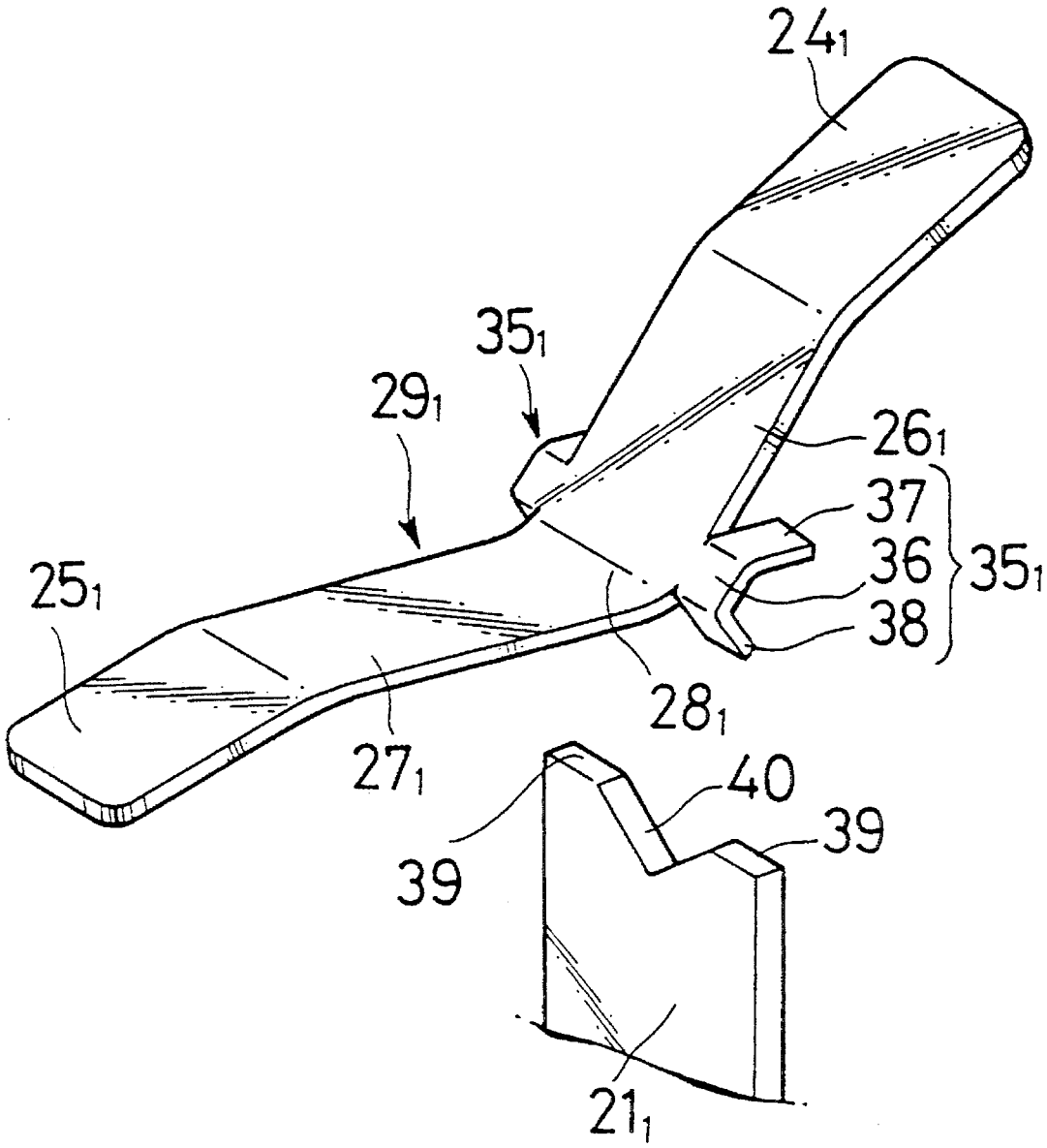

Referring also to FIGS. 4 and 5, the first switch mechanism $\mathbf{20}_1$ includes a conductive plate $\mathbf{21}_1$ serving as a common contact having a base end embedded in the housing 13 and a tip end projecting from the housing 13, a pair of first and second stationary contacts $\mathbf{22}_1$ and $\mathbf{23}_1$ fixed on the housing 13 on opposite sides of the conductive plate $\mathbf{21}_1$, respectively, a movable contact $\mathbf{29}_1$ carried at the tip end of the conductive plate $\mathbf{21}_1$ so that it can be switched into and out of alternative contact with the first and second stationary contacts $\mathbf{22}_1$ and $\mathbf{23}_1$, and an urging pin $\mathbf{30}_1$ carried on the operating member 15 and biased toward the movable contact $\mathbf{29}_1$ by a spring.

A guide hole $\mathbf{31}_1$ with its lower end opened is provided in a lower portion of the operating member 15 to extend vertically, and a window $\mathbf{32}_1$ for opening a side of the guide hole $\mathbf{31}_1$ is also provided in the lower portion of the operating member 15 to extend vertically. The bottomed cylindrical urging pin $\mathbf{30}_1$ is slidably fitted in the guide hole $\mathbf{31}_1$ and has a locking projection $\mathbf{33}_1$ locked in the window $\mathbf{32}_1$. A spring $\mathbf{34}_1$. FIG. 2 is compressed between a closed upper end of the guide hole $\mathbf{31}_1$ and the urging pin $\mathbf{30}_1$. Thus, the urging pin $\mathbf{30}_1$ is biased by the spring to project downwardly from the operating member 15 so as to resiliently abut against the movable contact $\mathbf{29}_1$. The locking of the locking projection $\mathbf{33}_1$ in a lower edge of the window $\mathbf{32}_1$ prevents the urging pin $\mathbf{30}_1$ from falling off from the operating member 15.

The movable contact $\mathbf{29}_1$, FIG. 4, includes a pair of first and second inclined portions $\mathbf{26}_1$ and $\mathbf{27}_1$ connected to a connection $\mathbf{28}_1$ in a substantially V-shape. The inclined portions $\mathbf{26}_1$ and $\mathbf{27}_1$ are provided at their outer ends with first and second contact portions $\mathbf{24}_1$ and $\mathbf{25}_1$ capable of individually being brought into contact with the first and second contacts $\mathbf{22}_1$ and $\mathbf{23}_1$, respectively. A portion of the first inclined portion $\mathbf{26}_1$ of the movable contact $\mathbf{29}_1$, closer to the connection $\mathbf{28}_1$, is pivotally supported on the tip end of the conductive plate $\mathbf{21}_1$.

The first stationary contact $\mathbf{22}_1$ is fixed to the housing 13 below the first contact portion $\mathbf{24}_1$, and the second stationary contact $\mathbf{23}_1$ is fixed to the housing 13 below the second contact portion $\mathbf{25}_1$. The first stationary contact $\mathbf{22}_1$ is fixed to the housing 13 at a level higher than that of the second stationary contact $\mathbf{23}_1$.

Support sections $\mathbf{35}_1$, $\mathbf{35}_1$ are integrally provided on opposite sides of the first inclined portion $\mathbf{26}_1$ at a location closer to the connection $\mathbf{28}_1$. Each of the support sections $\mathbf{35}_1$ is formed into a trapezoidal shape by a protruding portion 36 protruding sideways from the first inclined portion $\mathbf{26}_1$, a supporting plate portion 37 which is connected to one side edge of the protruding portion 36 adjacent the first inclined portion $\mathbf{26}_1$ to and which extend toward the first inclined portion $\mathbf{26}_1$ and which is inclined so that it is bending away from the first inclined portion $\mathbf{26}_1$ at a remote end from the protruding portion 36, and a limiting plate portion 38 continuously formed from the other side edge of the protruding portion 36 adjacent the second inclined portion $\mathbf{27}_1$.

Figure 6:
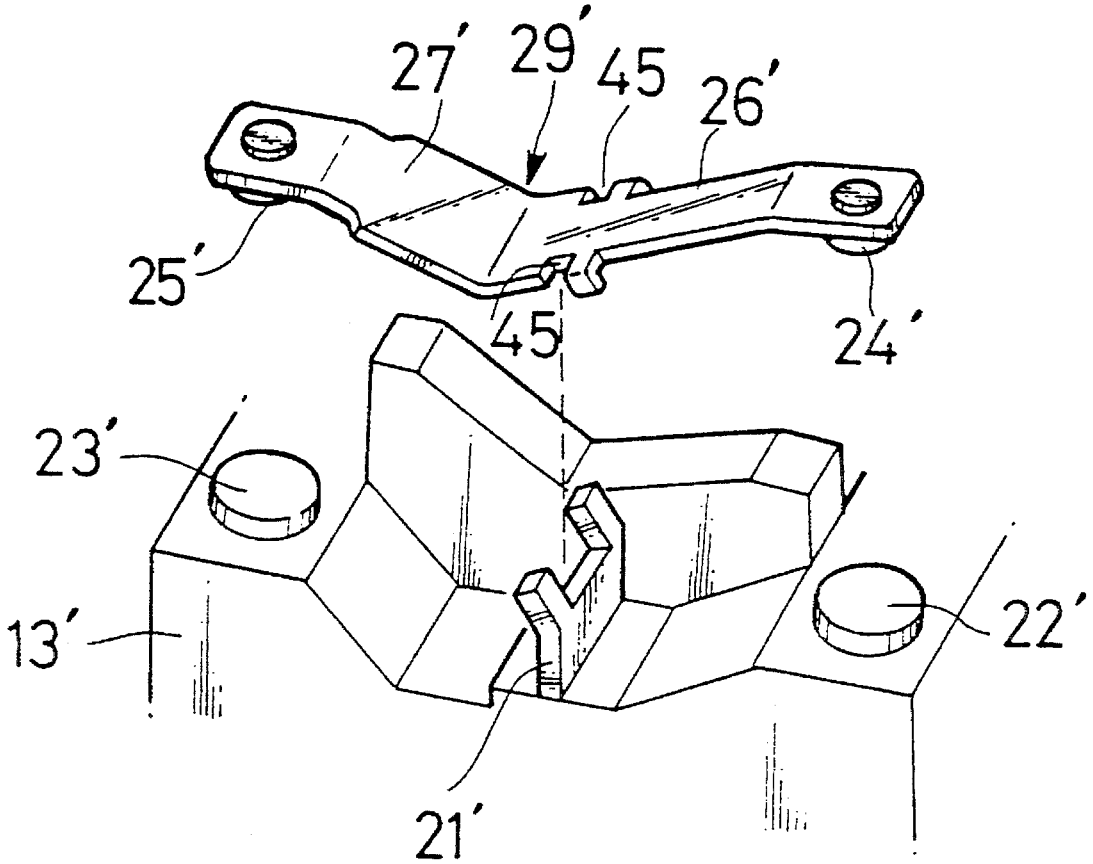
FIG.6 PRIOR ART
FIG. 6 is an exploded perspective view of a movable contact and a conductive plate in the prior art.

The tip end of the conductive plate $\mathbf{21}_1$, embedded in the housing 13 between the first and second stationary contacts $\mathbf{22}_1$ and $\mathbf{23}_1$ projects from the housing 13. The tip end of the conductive plate 21 is not bent (unlike the prior art shown in FIG. 6) and is a straight flat plate. The tip end of the conductive plate $\mathbf{21}_1$ is provided with a substantially V-shaped notch 40. FIG. 5, having to form, on opposite sides of the conductive plate, bearing portions 39, 39 which each abuts against the connection between the supporting plate portion 37 and the protruding portion 36 of corresponding one of the support sections $\mathbf{35}_1$, $\mathbf{35}_1$ of the movable contact $\mathbf{29}_1$.

When the knob $N_{RL}$ is in its neutral position, the urging pin $\mathbf{30}_1$ is in resilient abutment against the connection $\mathbf{28}_1$ of the movable contact $\mathbf{29}_1$. In this condition, the movable contact $\mathbf{29}_1$ is in a state to permit the second contact portion $\mathbf{25}_1$ to be brought into contact with the second stationary contact $\mathbf{23}_1$, while at the same time, permitting the first contact portion $\mathbf{24}_1$ to be brought out of contact with the first stationary contact $\mathbf{22}_1$. The limiting plate portions 38 of the support sections $\mathbf{35}_1$, $\mathbf{35}_1$ are in abutment against a side surface of the conductive plate $\mathbf{21}_1$ on the side of the stationary contact $\mathbf{23}_1$.

A partition wall 41, FIG. 3, is provided at a widthwise (laterally in FIG. 3) intermediate portion of the housing 13, and the first switch mechanism $\mathbf{20}_1$ is disposed on one side of the partition wall 41. The second switch mechanism $\mathbf{20}_2$ is disposed on the other side of the partition wall 41. The conductive plate $\mathbf{21}_2$, the pair of first and second stationary contacts $\mathbf{22}_2$ and $\mathbf{23}_2$ and the movable contact $\mathbf{29}_2$ of the second switch mechanism $\mathbf{20}_2$ are disposed in a point-symmetrical relation to the conductive plate $\mathbf{21}_1$, the pair of first and second stationary contacts $\mathbf{22}_1$ and $\mathbf{23}_1$ and the movable contact $\mathbf{29}_1$ of the first switch mechanism $\mathbf{20}_1$ with respect to a widthwise and lengthwise center point of the partition wall.

As shown in FIG. 2, a light guide member 42 for guiding light from a light source (not shown) is fixed on the support plate 9 with its end facing an inside of the sleeve 12. A lens 43 for receiving light from the light guide member 42 is mounted to each of the knobs $N_M$, $N_{FR}$, $N_{FL}$, $N_{RR}$ and $N_{RL}$ to face an outer surface thereof.

The operation of this embodiment will be described below. If a front end (a left end as viewed in FIG. 2) of the knob $N_{RL}$ in its neutral position is pushed down, the operating member 15 is swung counterclockwise as viewed in FIG. 2. In response to this, the urging pin $\mathbf{30}_1$ in the first switch mechanism $\mathbf{20}_1$ moves onto the first inclined portion $\mathbf{26}_1$ of the movable contact $\mathbf{29}_1$. This causes the movable contact $\mathbf{29}_1$ to be turned clockwise as viewed in FIG. 2 to bring the contact portion $\mathbf{24}_1$ into contact with the stationary contact $\mathbf{22}_1$, while at the same time, bringing the second contact portion $\mathbf{25}_1$ out of contact with the second stationary contact $\mathbf{23}_1$. In the second switch mechanism $\mathbf{20}_2$, the urging pin $\mathbf{30}_2$ moves onto the second inclined portion $\mathbf{27}_2$ of the movable contact $\mathbf{29}_2$, and the second contact portion $\mathbf{25}_2$ is maintained in contact with the second stationary contact $\mathbf{23}_2$. In this condition, the springs $\mathbf{34}_1$ are compressed by contact of the urging pins $\mathbf{30}_1$ and $\mathbf{30}_2$ with the inclined portion $\mathbf{26}_1$ of the first switch mechanism $\mathbf{20}_1$ and the second inclined portion $\mathbf{27}_2$ of the second switch mechanism $\mathbf{20}_2$. Therefore, the operating member 15 is biased in such a direction that the urging pins $\mathbf{30}_1$ and $\mathbf{30}_2$ are slid on the inclined portions $\mathbf{26}_1$ and $\mathbf{27}_2$ back to the connections $\mathbf{28}_1$ and $\mathbf{28}_2$. When an occupant releases his or her hand from the knob $N_{RL}$, the operating member 15 is promptly returned into its neutral position in which the urging pins $\mathbf{30}_1$ and $\mathbf{30}_2$ are brought into contact with the connections $\mathbf{28}_1$ and $\mathbf{28}_2$.

If a rear end (a right end as viewed in FIG. 2) of the knob $N_{RL}$ in its neutral position is pushed down, the operating member 15 is swung clockwise as viewed in FIG. 2. In response to this, the urging pin $\mathbf{30}_1$ in the first switch mechanism $\mathbf{20}_1$ moves onto the second inclined portion $\mathbf{27}_1$ of the movable contact $\mathbf{29}_1$, and the second contact portion $\mathbf{25}_1$ is maintained in contact with the second stationary contact $\mathbf{23}_1$. In the second switch mechanism $\mathbf{20}_2$, the urging pin $\mathbf{30}_2$ moves onto the first inclined portion $\mathbf{26}_2$ of the movable contact $\mathbf{29}_2$. This causes the first contact portion $\mathbf{24}_2$ to be brought into contact with the first stationary contact $\mathbf{22}_2$, while at the same time, causing the second contact portion $\mathbf{25}_2$ to be brought out of contact with the second stationary contact $\mathbf{23}_2$. Even in this case, if the occupant releases his or her hand from the knob $N_{RL}$, the operating member 15 is promptly returned into its neutral position in which the urging pins $\mathbf{30}_1$ and $\mathbf{30}_2$ are brought into contact with the connections $\mathbf{28}_1$ and $\mathbf{28}_2$.

In such switch device, the tip ends of the conductive plates $\mathbf{21}_1$ and $\mathbf{21}_2$ embedded in the housing 13 project in the form of the non-bent, straight and flat plates from the housing. And the support sections $\mathbf{35}_1$, $\mathbf{35}_1$ and $\mathbf{35}_2$, $\mathbf{35}_2$ are integrally provided on the opposite sides of the movable contacts $\mathbf{29}_1$ and $\mathbf{29}_2$ in such a manner that the movable contacts $\mathbf{29}_1$ and $\mathbf{29}_2$ are pivotally supported at the tip ends of the conductive plates $\mathbf{21}_1$ and $\mathbf{21}_2$. Thus, it is unnecessary to bend the one ends of the conductive plates $\mathbf{21}_1$ and $\mathbf{21}_2$ after being coupled, by molding, to the housing 13, and it is possible to form the support sections $\mathbf{35}_1$, $\mathbf{35}_1$ and $\mathbf{35}_2$, $\mathbf{35}_2$ simultaneously when forming the movable contacts $\mathbf{29}_1$ and $\mathbf{29}_2$, thus eliminating the need for conducting a troublesome bending operation, and leading to an increased assembling efficiency.

Although the embodiment of the present invention has been described in detail, it will be understood that the present invention is not limited to the above-described embodiment, and various modifications in design can be made without departing from the spirit and scope of the invention defined in claims.

For example, although the pair of switch mechanisms $\mathbf{20}_1$ and $\mathbf{20}_2$ are operated in the switching manner by swinging operation of the operating member 15, a single switch mechanism may be operated by the operating member 15.

What is claimed is:

1. A switch device, comprising:

a conductive plate embedded in a housing of synthetic resin and having a projecting end projecting from said housing, said projecting end having a non-bent, flat, plate-like configuration;

a pair of stationary contacts fixed on the housing on opposite sides of said conductive plate;

a movable contact continuously provided with first and second opposing inclined portions along a longitudinal axis thereof defining a substantially V-shape and provided at outer ends of said inclined portions with contact portions capable of being individually brought into contact with said stationary contacts, said first inclined portion of said movable contact being pivotally supported about a transverse axis thereof on said projecting end of said conductive plate;

an operating member mounted on said housing and about an axis parallel to said axis of pivoting movement of said movable contact; and an urging pin carried on said operating member and biased toward the movable contact by a spring, said urging member being slidable on said moving contact between opposite sides of said conducting plate;

wherein said switch device is switchable in order to selectively bring said contact portions into and out of contact with said stationary contacts depending upon the sliding movement said urging on said movable contact in response to swinging movement of said operating member, and further wherein said first inclined portion of said movable contact is integrally provided, at opposite lateral sides thereof, with support sections for receiving said projecting end of said conductive plate, and wherein each support section is formed in a trapezoidal shape by a protruding portion protruding sideways from said first inclined portion, a supporting plate portion continuously formed on an edge of said protruding portion adjacent the first inclined portion and extending on the side of said first inclined portion, and a limiting plate portion continuously formed on an edge of said protruding portion adjacent the second inclined portion.

2. A switch device according to claim 1, wherein said projecting end of the conductive plate is placed in engagement with bent portions of said support sections connecting said protruding portions and said supporting plate portions.

3. A switch device according to claim 1, wherein said limiting plate portion limits the pivoting movement of said movable contact toward the second inclined portion.

4. A switch device according to claim 1, wherein said movable contact is formed from a single metal plate.

5. A switch device according to claim 1, wherein said stationary contact corresponding to the contact portion of the first inclined portion is placed at a level higher than that of the stationary contact corresponding to the contact portion of the second inclined portion.

6. A switch device, comprising:

a conductive plate embedded in a housing of synthetic resin and having a projecting end projecting from said housing;

a pair of stationary contacts fixed on the housing on opposite sides of said conductive plate;

a movable contact continuously provided with first and second opposing inclined portions defining a substantially V-shape and provided at outer ends of said inclined portions with contact portions capable of being individually brought into contact with said stationary contacts, said first inclined portion being pivotally supported on said projecting end of said conductive plate;

an operating member swingable about an axis parallel to an axis of pivoting movement of said movable contact; and an urging pin carried on said operating member and biased toward said movable contact by a spring, wherein said switch device is switchable in order to selectively bring said contact portions into and out of contact with said stationary contacts depending upon said urging pin with said stationary contact in response to swinging movement of said operating member, and further wherein said first inclined portion of said movable contact is provided, at opposite lateral sides thereof, with support means for supporting said movable contact on said projecting end of said conductive plate by engaging said projecting end of said conductive plate, wherein said supporting means includes an inverted V-shaped support piece provided on said first inclined portion for engaging the projecting end of said conductive plate, said support piece further having a protruding portion protruding sideways from said first inclined portion, and a supporting plate portion continuously formed on an edge of said protruding portion adjacent said first inclined portion.

7. A switch device according to claim 6, wherein said projecting end of the conductive plate is placed in engagement with bent portions of said supporting pieces connecting said protruding portions and said supporting plate portions.

8. A switch device according to claim 6, wherein said support piece and said movable contact are formed from a single metal plate.

9. A switch device according to claim 6, wherein said V-shaped support piece further includes a limiting means for limiting the pivoting movement of the movable contact.

10. A switch device according to claim 9, wherein said limiting means is a limiting plate portion which abuts against said conductive plate during pivoting movement of said movable contact mounted on the edge of the support piece.

11. A switch device according to claim 10, wherein said support piece, said limiting plate portion and said movable contact are formed from a single metal plate.

* * * * *